US008297777B1

(12) United States Patent
McCall

(10) Patent No.: US 8,297,777 B1
(45) Date of Patent: Oct. 30, 2012

(54) BARRIER WITH ORNAMENTAL LIGHTING

(75) Inventor: Duane M. McCall, Parker, CO (US)

(73) Assignee: Mile High Balusters, Englewood, CO (US)

( * ) Notice: Subject to any disclaimer, the term of this patent is extended or adjusted under 35 U.S.C. 154(b) by 0 days.

(21) Appl. No.: 11/714,493

(22) Filed: Mar. 5, 2007

Related U.S. Application Data

(60) Provisional application No. 60/779,065, filed on Mar. 3, 2006.

(51) Int. Cl.
*F21S 8/00* (2006.01)

(52) U.S. Cl. ..... 362/146; 362/145; 362/152

(58) Field of Classification Search ..... 362/145, 362/146, 152, 465
See application file for complete search history.

(56) References Cited

U.S. PATENT DOCUMENTS

| | | | | | |
|---|---|---|---|---|---|
| 1,794,467 | A | * | 3/1931 | Lucas | 362/152 |
| 2,310,593 | A | * | 2/1943 | Orlicki | 362/146 |
| 2,721,255 | A | * | 10/1955 | Lanmon | 362/146 |
| 3,222,509 | A | * | 12/1965 | Thedford | 362/152 |
| 3,448,257 | A | * | 6/1969 | Sackett, Jr. | 362/146 |
| 4,161,769 | A | * | 7/1979 | Elliott | 362/146 |
| 4,586,030 | A | * | 4/1986 | Klostermann | 340/550 |
| 5,701,236 | A | * | 12/1997 | Viviano | 362/576 |
| 6,425,676 | B1 | | 7/2002 | Lyons | |
| 6,505,950 | B1 | | 1/2003 | Natoli et al. | |
| 6,585,398 | B1 | | 7/2003 | Haddad | |
| 6,916,103 | B2 | | 7/2005 | Currie et al. | |
| 6,986,589 | B2 | | 1/2006 | Evans et al. | |
| 7,131,747 | B1 | | 11/2006 | Yates | |
| 2002/0005826 | A1 | | 1/2002 | Pederson | |
| 2004/0107615 | A1 | | 6/2004 | Pare | |
| 2006/0023454 | A1 | | 2/2006 | Koren | |
| 2006/0203477 | A1 | | 9/2006 | Chien | |
| 2007/0019415 | A1 | | 1/2007 | Leblanc et al. | |

* cited by examiner

*Primary Examiner* — Danielle Allen
(74) *Attorney, Agent, or Firm* — Mitchell K. McCarthy; McCarthy Law Group

(57) ABSTRACT

A railing is provided with a pair of adjacent upright posts. Substantially parallel and spatially disposed opposing rails are supported by the posts. A plurality of balusters span the rails between the adjacent pair of posts, with the plurality of balusters defining first spaces between adjacent balusters and defining second spaces between each post and the respective adjacent baluster. One or more groups of one or more illuminating members are supported by each of a predetermined number of lighted balusters of the plurality of balusters.

17 Claims, 11 Drawing Sheets

BARRIER WITH ORNAMENTAL LIGHTING

RELATED APPLICATIONS

This application claims benefit to the filing date of U.S. 60/779,065 filed Mar. 3, 2006.

FIELD OF THE INVENTION

The embodiments of the present invention relate generally to the field of barrier construction and more particularly without limitation to an apparatus and associated methodology for incorporating accent lighting into a barrier for safety and aesthetics purposes.

BACKGROUND OF THE INVENTION

Outdoor living spaces have become popular extensions of a house or building for various purposes such as personal relaxation and group entertainment. Such outdoor living spaces are often provided with decorative railing systems for the purpose of providing a barrier, such as in enclosing a pool or a hot tub, or in demarcating the edge of an elevated deck.

Outdoor lighting is an important design element receiving more attention to detail these days as home and building owners seek to effectively make the outdoor living space suitable for its intended purposes at night, yet be aesthetically pleasing. For instance, flood lighting has been used extensively in the past for its practicality. It can illuminate an area at night virtually the same as is in the daytime. However, often a different, more relaxed atmosphere is desired for the outdoor living space at night than what flood lighting can provide.

There is a continued need for improvements in the way that outdoor structures such as railing systems are integrated with accent lighting features to create subtle and dramatic smatterings of lights that effectively light an area, but does so in a mystically beautiful display of lighting. It is to these improvements that the embodiments of the present invention are directed.

SUMMARY OF THE INVENTION

In some embodiments a railing is provided having a pair of upright adjacent posts. Substantially parallel and spatially disposed opposing rails are supported by the posts. Two or more longitudinal members are supported by at least one of the posts and the rails, and are spatially disposed between the pair of adjacent posts defining spaces between adjacent longitudinal members. An illuminating feature is supported by at least one of the longitudinal members.

In some embodiments a railing is provided with a pair of adjacent upright posts. Substantially parallel and spatially disposed opposing rails are supported by the posts. A plurality of balusters span the rails between the adjacent pair of posts, with the plurality of balusters defining first spaces between adjacent balusters and defining second spaces between each post and the respective adjacent baluster. One or more groups of one or more illuminating members are supported by each of a predetermined number of lighted balusters of the plurality of balusters.

In some embodiments a railing is provided with posts supporting first and second substantially parallel rails with two or more balusters between adjacent posts supported at proximal and distal ends by the first and second rails, respectively, and means for lighting the balusters individually.

DETAILED DESCRIPTION

Figure 1:
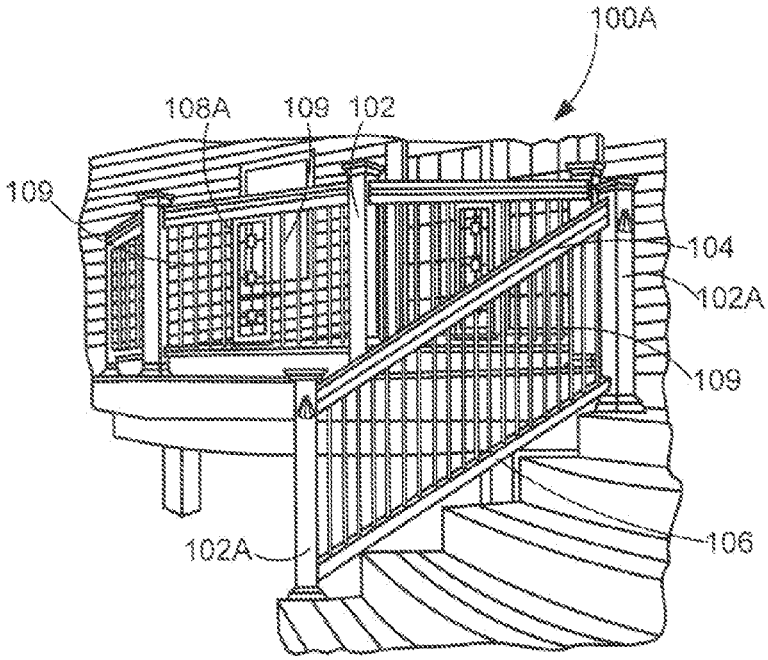
FIG. 1 is a view of a railing system constructed in accordance with embodiments of the present invention.

Referring to the drawings in general, and more particularly to FIG. 1, shown therein is a railing 100A constructed in accordance with embodiments of the present invention that continuously traverses a set of steps and circumscribes the perimeter of an elevated outdoor deck. The railing 100A is generally constructed of spaced-apart upright posts 102 supporting opposing top and bottom rails 104, 106 which, in turn, support a plurality of balusters 108. The present embodiments contemplate railings 100 having lighting effects, such as for safety purposes as shown by the posts 102A that illuminate the steps below. The present embodiments further contemplate railings 100 having other lighting effects, such as for aesthetics purposes as shown by the balusters 108A that enhance the decorative effect of the railing 100A in darkness.

Figure 2:
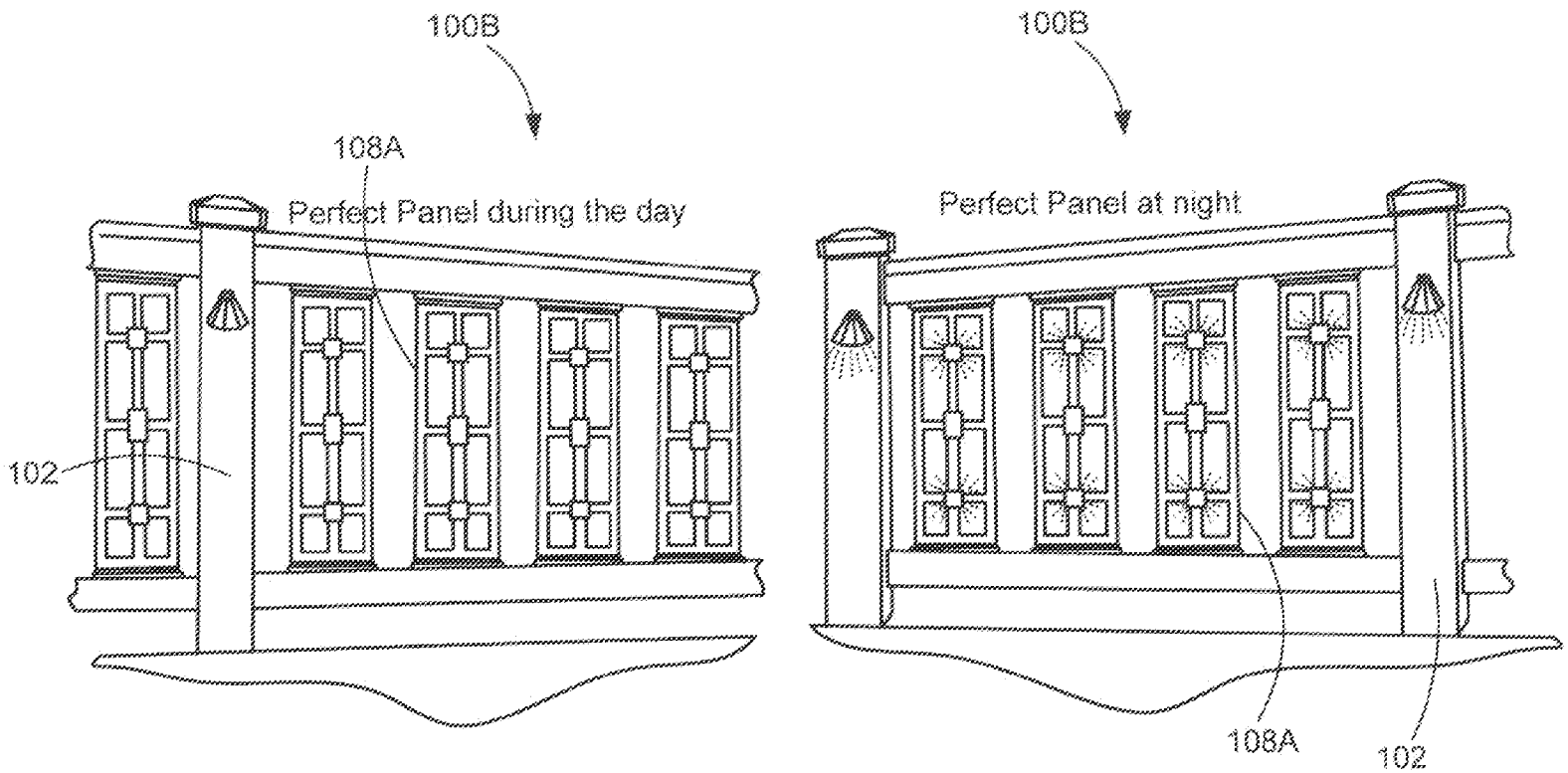
FIG. 2 is a view of a railing system constructed in accordance with alternative embodiments of the present invention.

The desired amount of lighting effect is easily accomplished by varying the number of lighted balusters as opposed to non-lighted balusters in a particular section of the railing 100A. For example, in FIG. 1 that portion of the railing 100 traversing the stairs has lighted posts 102A only, and entirely non-lighted balusters 109. The non-lighted balusters 109 can be constructed of any feasible construction material, but preferably are weather-resistant materials such as but not limited to coated or anodized aluminum. Contrarily, each section of that portion of the railing 100A circumscribing the elevated deck has a centrally disposed lighted baluster 108A surrounded by non-lighted balusters 109. FIG. 2 shows a similar railing 100B, both during the day and at night, but having a relatively greater lighting effect by having all lighted balusters 108A within the section between the posts 102.

Figure 3:
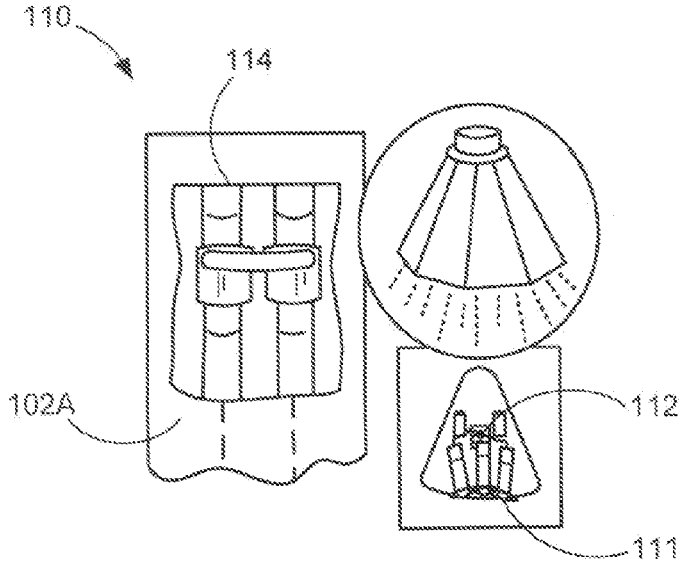
FIG. 3 is an enlarged view of a lighting member on the post of the railing system of FIG. 1.

FIG. 3 is an enlarged detail view of a light 110 used on the post 102A. Two differently shaped covers are illustrated, both of which are open on the bottom end in order to direct light in that direction. Also illustrated is an "invisible" cover showing an arrangement of three light emitting diodes (LEDs) 111 used to provide the lighting. Preferably the LEDs 111 operate on 12 volts direct current to provide ample wattage while yet providing long life, such as on the order of 25,000 hours. It will be noted that the wiring to the LEDs 111 passes through an opening 112 that communicates with an internal passage 114 in the post 102A. Similar internal passages can be provided in the top and/or bottom rails 104, 106 to communicate with the passage 114 in the post 102 in order to route the electrical wiring in a manner such that it is entirely hidden from view.

Figure 4:
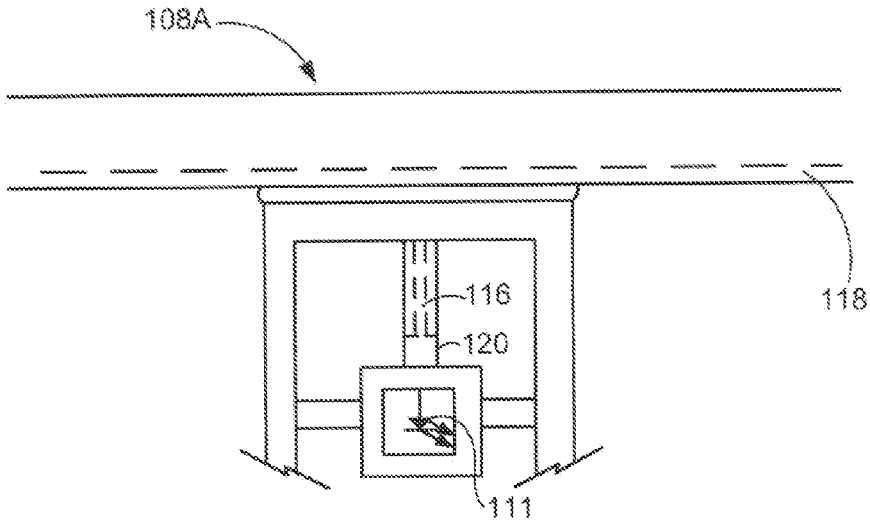
FIG. 4 is an enlarged detail view of the lighted baluster of the railing system of FIG. 1.

FIG. 4 is an enlarged detail of a portion of the lighted baluster 108A illustrating how in some embodiments of the present invention the LED 111 is replaceable without dismantling the railing 100. For example, the baluster 108A has an internal passage 116 that operably communicates with a passage 118, in this case a slot, through which the electrical wiring is routed to a socket 120. The internal passage 116 can be provided such as by a relief in a casting. The LED 111 can be inserted into the socket 120 and removed therefrom.

Figure 5:
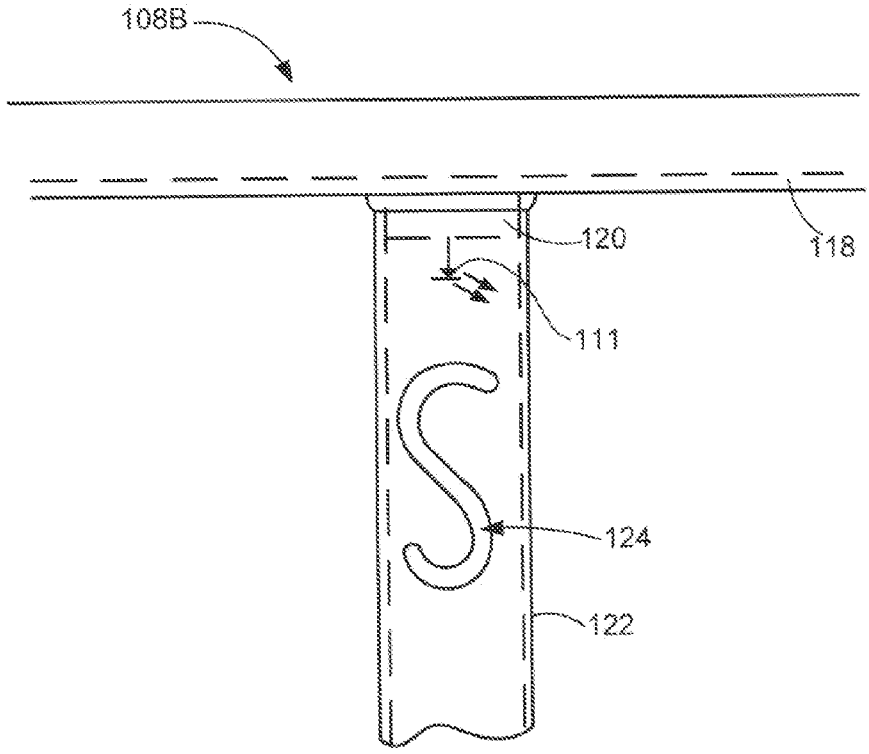
FIG. 5 is an enlarged detail view of a lighted baluster constructed in accordance with alternative embodiments of the present invention.

FIG. 5 is an enlarged detail of a portion of a lighted baluster 108B illustrating how in some embodiments of the present invention the LED 111 is nonreplaceable without dismantling the railing 100. For example, the baluster 108B is made of a hollow tubing member 122 into which is attached the LED 111. A decoratively shaped opening 124 can be defined through the wall thickness of the tubing member 122, through which light from the LED 111 is emitted. The opening 124 can be defined as part of the manufacture of the tubing member 122, such as in a casting, or it can be secondarily machined into the tubing member 122, such as by milling. Although only one LED 111 is shown above the opening 124 in FIG. 5, in equivalent alternative embodiments another LED 111 can be provided below the opening 124 for more lighting intensity and a more uniform emission of light throughout the opening 124.

Figure 8:
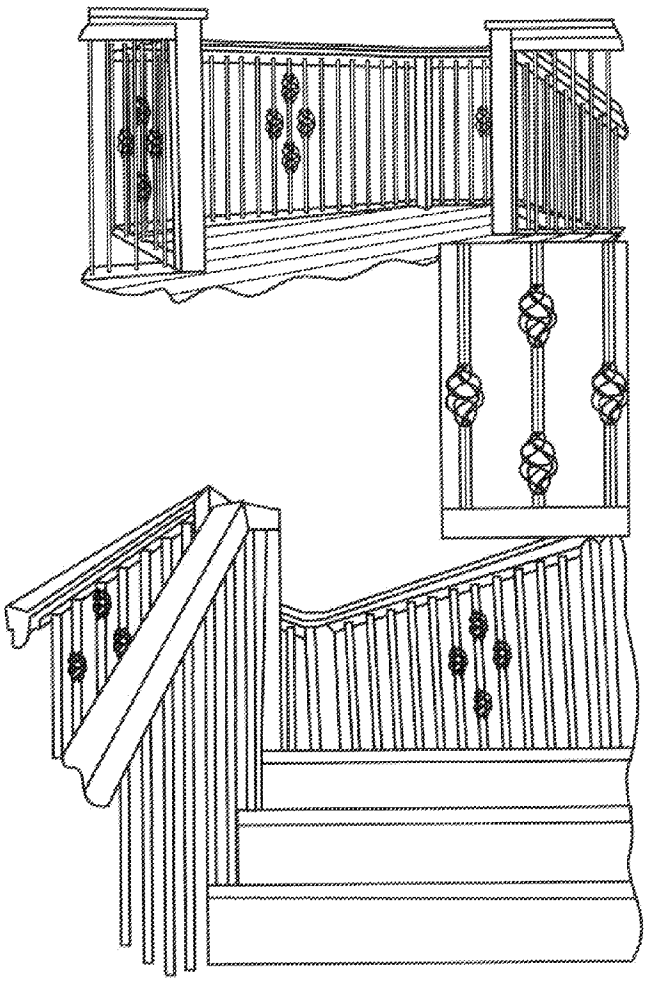
FIGS. 7-9 illustrate railing systems of various arrangements made from the modular lighted baluster segments shown in FIG. 6.
Figure 6:
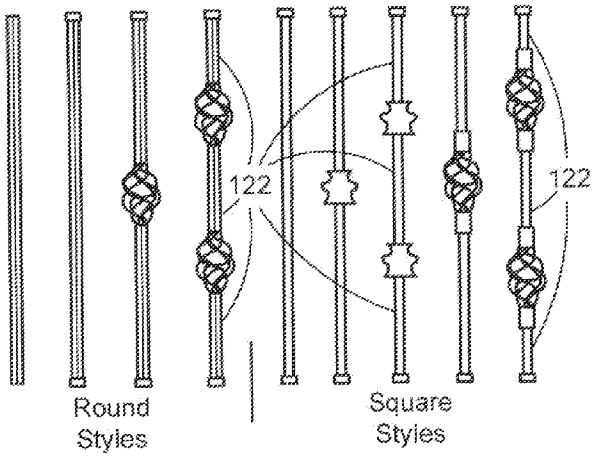
FIG. 6 illustrates a number of different arrangements made from modular lighted baluster segments.
Figure 7:
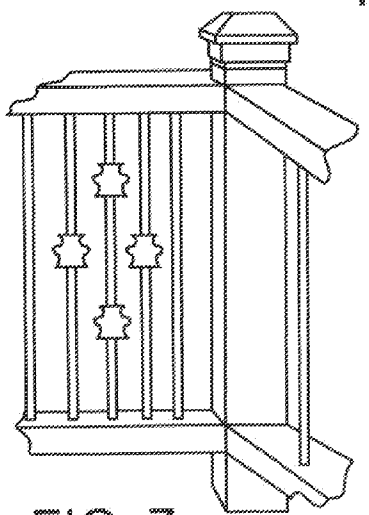
Figure 9:
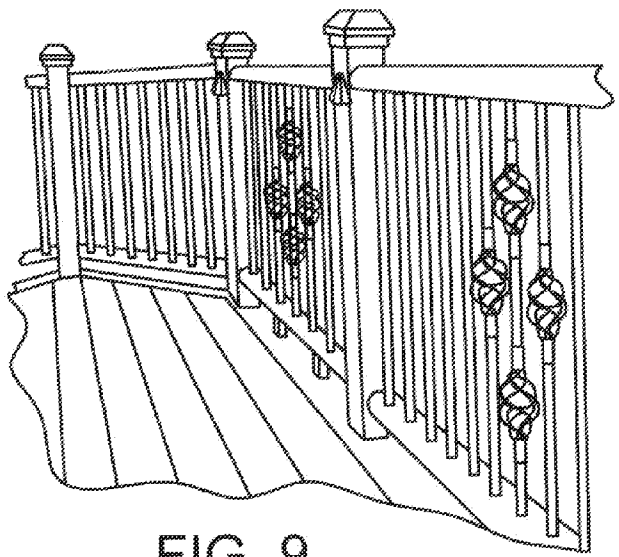

FIG. 6 shows how the lighted portion of a baluster 108 can be made as a modular component and selectively positioned to achieve a desired aesthetic arrangement. For example, groups of round tube and square tubes both show open lighted segments and closed lighted segments in both single and dual arrangements within a baluster 108. FIG. 7 shows a decorative arrangement of the closed segments and FIG. 8 shows a similar arrangement of the open segments. FIG. 9 shows the open segments arranged as in FIG. 8 but also showing the segments being selected of a contrasting color from the rest of the baluster components for additional aesthetic appeal.

Figure 10:
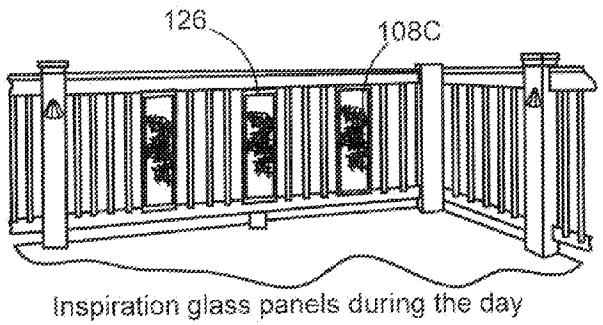
FIG. 10 is a view of a railing system constructed in accordance with alternative embodiments of the present invention.
Figure 10:
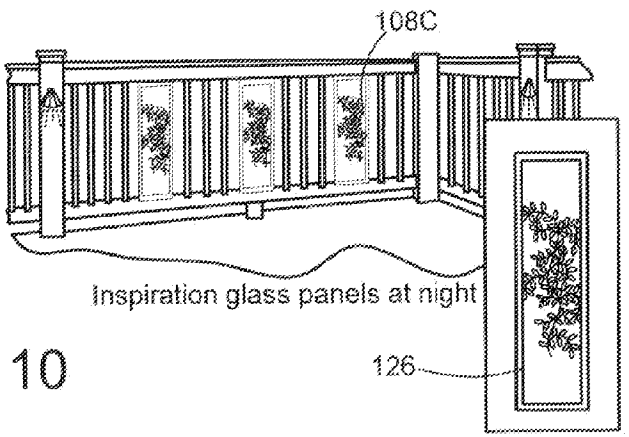
Figure 11:
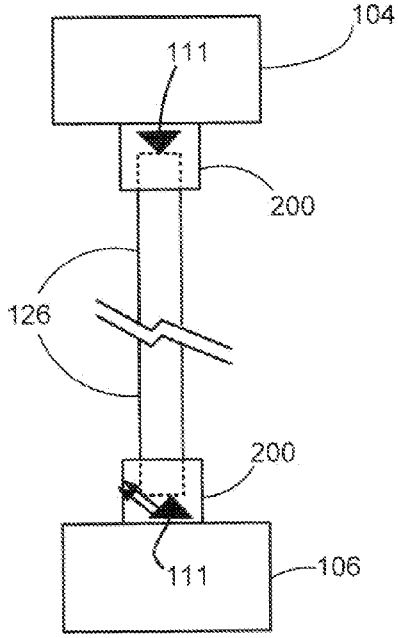
FIG. 11 is a cross section diagrammatic view of the railing system of FIG. 10.

FIG. 10 shows other embodiments of the present invention whereby a lighted baluster 108C is provided by directing a light source into the plane of a sheet of transparent material 126. FIG. 11 more particularly illustrates the manner in which opposing LEDs 111 can be mounted adjacent the top rail 104 and bottom rail 106 in edgewise relation to the sheet of material 126 so that the direction of light emitted from the LEDs 111 is coplanar with the sheet of material 126. The sheet of material can be acrylic or glass, for example, and preferably can be decoratively etched in order to enhance the lighted effects, such as best shown in the nighttime illustration of FIG. 10.

Figure 16:
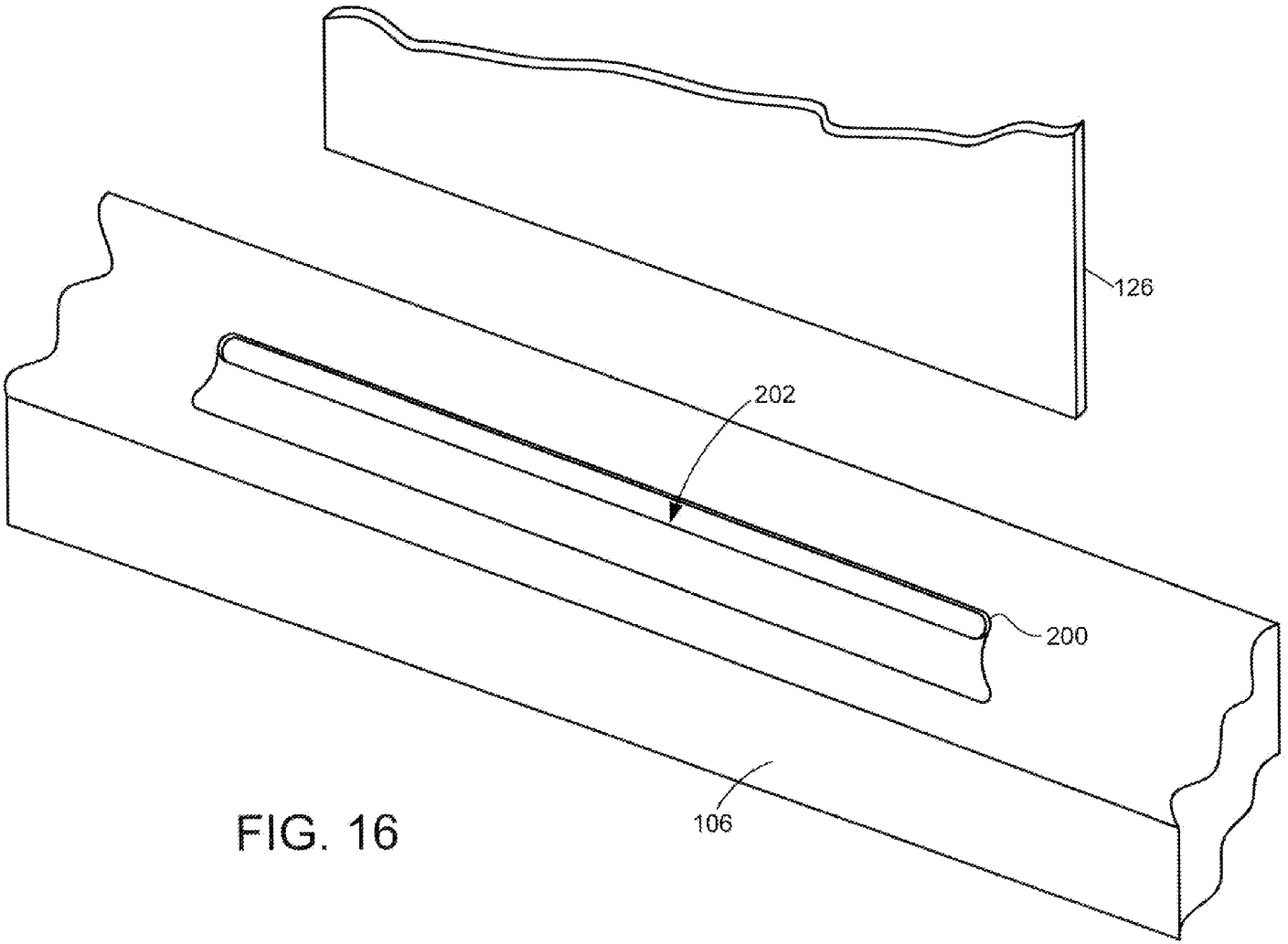
FIG. 16 is an isometric view of the end cap for the baluster in the railing system of FIG. 10.

FIG. 16 is an enlarged detail view showing an end cap 200 attached to the bottom rail 106 for supporting one end of the sheet of material 126. The end cap 200 is preferably made of a weather-resistant material such as but not limited to aluminum or a polymeric material. The end cap 200 defines a longitudinal opening 202 which receivingly engages the end of the sheet of material 126.

Figure 17:
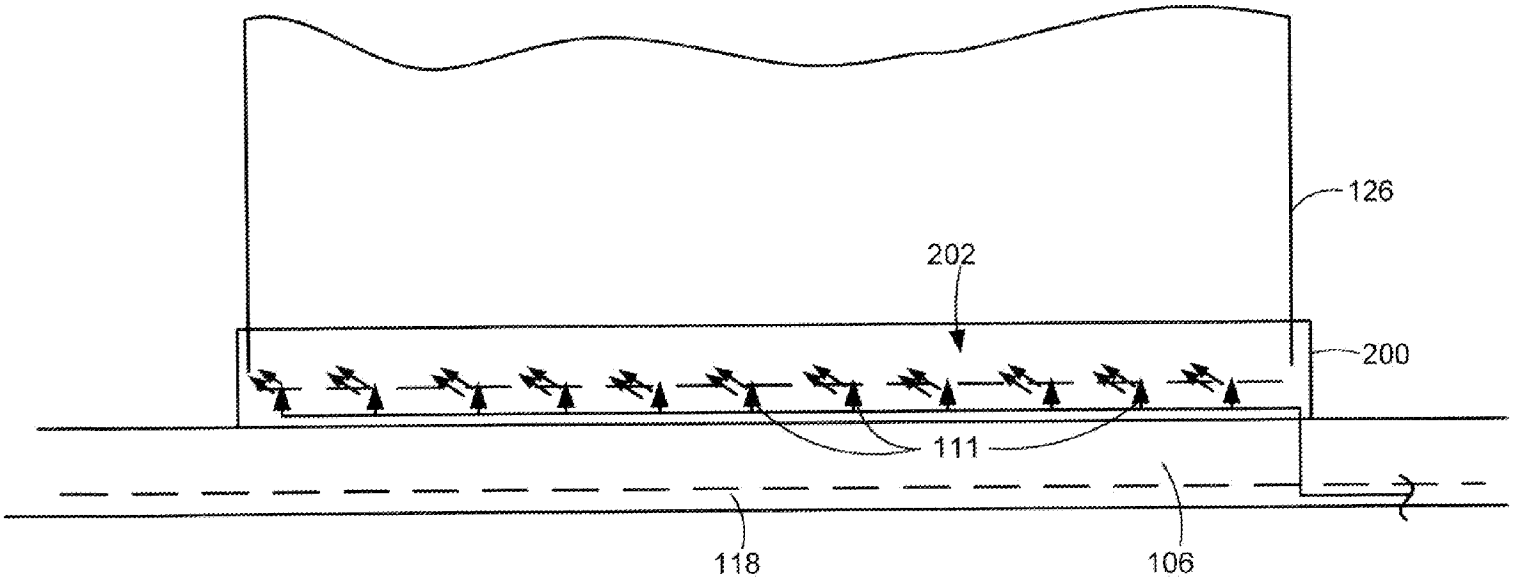
FIG. 17 is a side view of the end cap of FIG. 16.

FIG. 17 is a diagrammatic side view of an end cap 200 supporting a plurality of the LEDs 111 so as to direct the emitted light into the opening 202, and thereby into the edge of the sheet of material 126 when it is operably supported by the end cap 200.

Figure 12:
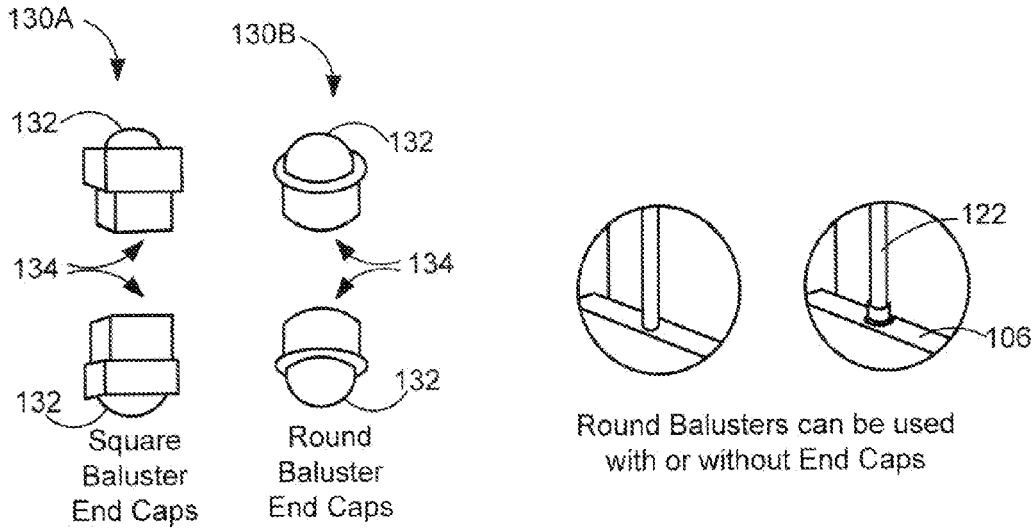
FIG. 12 is a view of end caps between vertical balusters and horizontally disposed rails.
Figure 13:
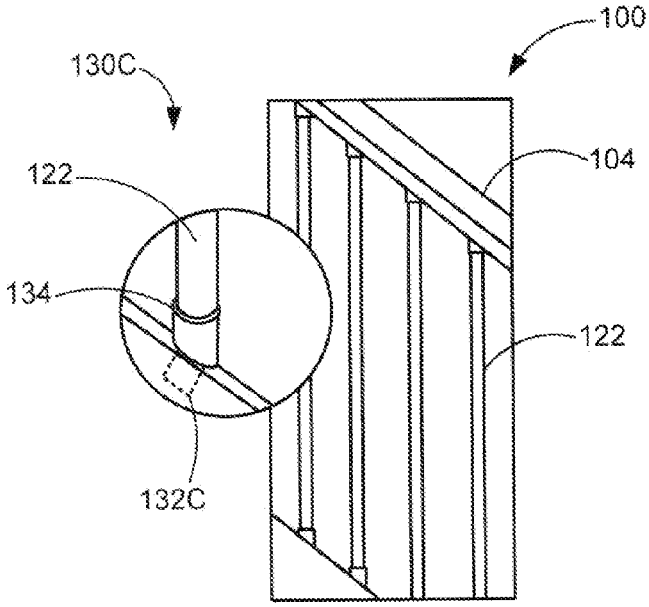
FIG. 13 is a view of end caps between vertical balusters and non-horizontally disposed rails.

FIG. 12 shows end caps 130 that can be used to decoratively enhance the joinder of the portion of the tubing 122 to the top and bottom rails 104, 106. The end caps 130 define a protuberant end 132 that engages the rail 104, 106 and an opposing cavity 134 for receivingly engaging the tubing 122. The cavity 134 can define a desired shape opening, such as square or round, for receivingly engaging like tubing in a close fitting engagement. It will be noted that in FIG. 12 the protuberant end 132 and cavity 134 are disposed along a collinear axis for attaching the tubing member 122 substantially transversely to the rail 104, 106. Alternatively, FIG. 13 shows an end cap 130C having the protuberant end 132C angularly disposed in relation to the cavity 134 for attaching the tubing member 122 in a non-transverse relation to the rail 104, 106, such as in the stair railing 100 illustrated.

Figure 14:
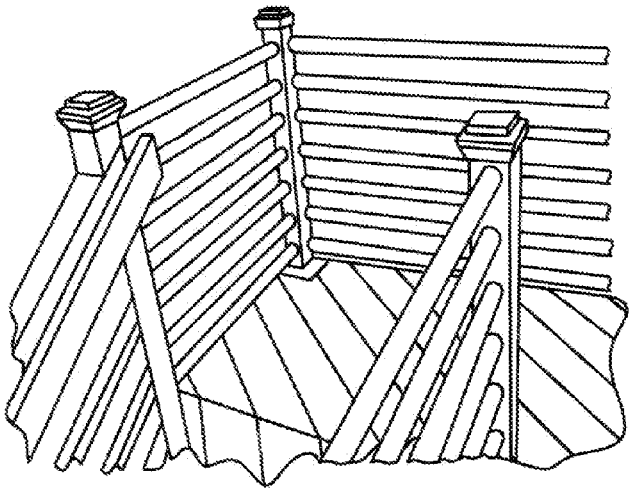
FIGS. 14-15 illustrate railing systems constructed in accordance with alternative embodiments of the present invention.
Figure 15:
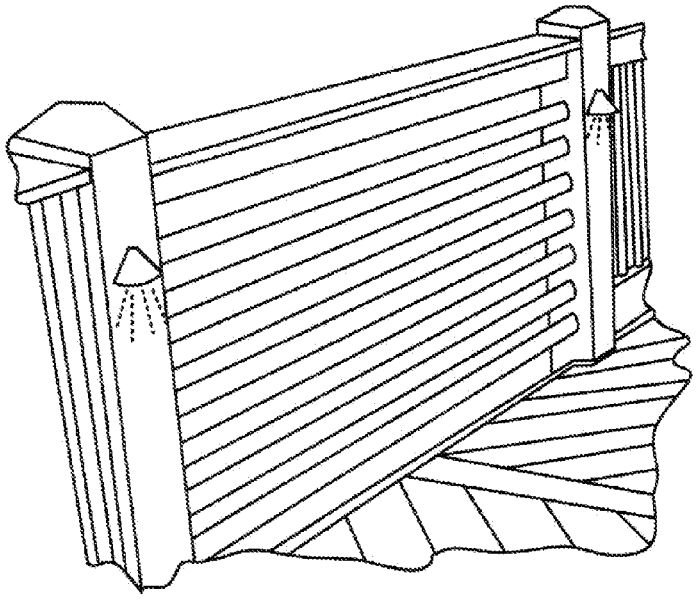

FIGS. 14 and 15 illustrate other embodiments whereby the balusters, whether lighted or non-lighted, can be disposed horizontally rather than vertically as above (sometimes referred to as "railings").

Figure 18:
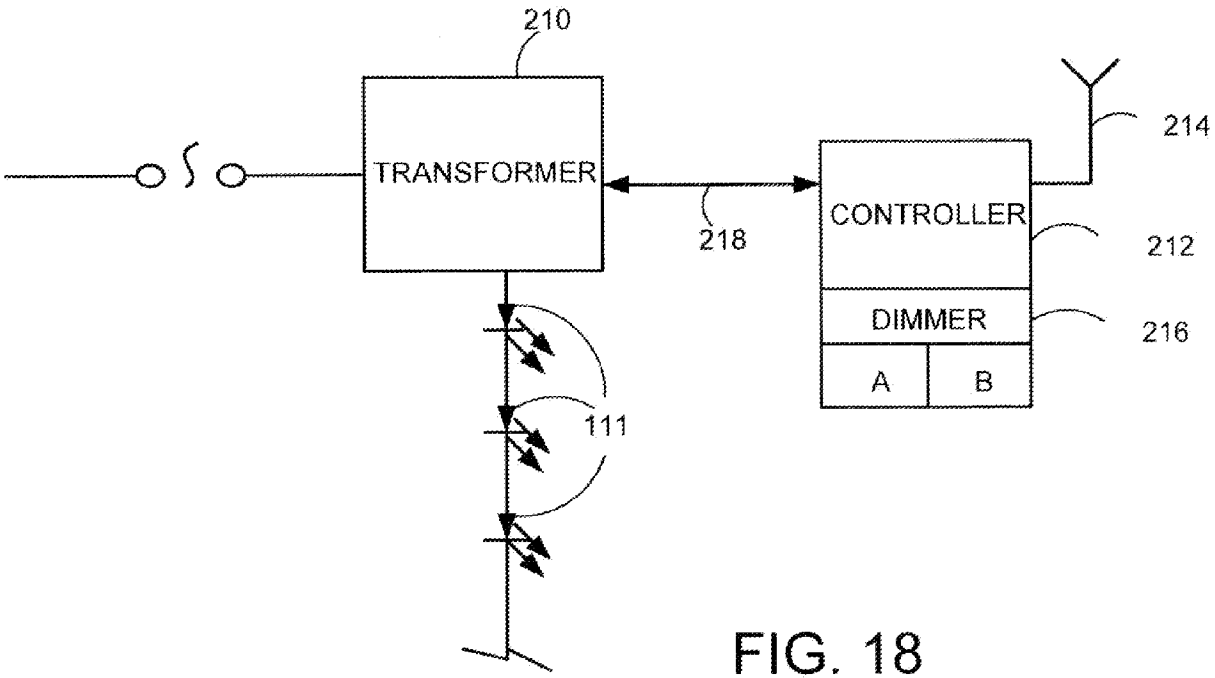
FIG. 18 is a control diagram of a railing system of the present embodiments.

FIG. 18 is a control diagram wherein a variable transformer 210 receives an alternating current supply voltage and provides power to the plurality of LEDs 111. A remotely-disposed controller 212 has an antenna for receiving radio frequency signals from a remote transmitter, such as a hand-held remote control operated by a user of the present invention. The controller 212 can operate in response to signals received by one of a plurality of communication channels, such as channels A and B illustrated. Signals received over a channel can be used by a dimmer module 216 to send signals over a bus 218, such as an RS232 interface, to the transformer to control the intensity of the LEDs 111.

Generally, a railing (such as 100) is provided with a pair of upright adjacent posts (such as 102). Substantially parallel and spatially disposed opposing rails (such as 104) are supported by the posts. Two or more longitudinal members are supported by at least one of the posts and the rails and spatially disposed between the pair of adjacent posts defining spaces between adjacent longitudinal members. An illuminating feature is supported by at least one of the longitudinal members.

At least one of the longitudinal members can be characterized by a cross section defining an annular region, and wherein the illuminating feature comprises an electrical socket (such as 120) supported by the longitudinal member within the annular region. The illuminating feature can include a light emitting member (such as light emitting diode 111) that is operably removable from the socket and replaceable without disturbing the disposition of the respective longitudinal member in relation to the rails and the posts (such as in FIG. 4).

The longitudinal members can be substantially vertical balusters (such as 108, 109) supported at proximal and distal ends thereof by the opposing rails, wherein two of the balusters spatially define second spaces with which they are each disposed from a respective post of the adjacent pair of posts. Alternatively, the longitudinal members can be substantially horizontal railings (such as in FIGS. 14 and 15) supported at proximal and distal ends thereof by the adjacent pair of posts, wherein two of the railings spatially define second spaces with which they are each disposed from a respective rail of the opposing pair of rails.

Alternatively, the longitudinal members can include a solid light transmitting sheet (such as 126) with the illuminating feature disposed in an edgewise relation to the sheet (as shown in FIG. 17). In this case an end cap can be attached to a selected one of the posts and rails, the end cap defining a slot (such as 202) that is sized to receivingly engage one end of the sheet. The light emitting member can thereby be supported by the end cap adjacent the slot.

The longitudinal member can define an internal passage (such as 116) in communication with the annular region, the passage sized for passing an electrical conductor to the socket. Furthermore, one of the posts and railings can define a second passage (such as 118) in communication with the longitudinal passage, the second passage also sized for passing an electrical conductor to the socket.

Alternatively characterized, the present embodiments contemplate a railing having a pair of adjacent upright posts (such as 102). Substantially parallel and spatially disposed opposing rails (such as 104) are supported by the posts. A plurality of balusters span the rails between the adjacent pair of posts, the plurality of balusters defining first spaces between adjacent balusters and defining second spaces between each post and the respective adjacent baluster. One or more groups of one or more illuminating members (such as LEDs 111) is each supported by a respective lighted baluster (such as 108) of the plurality of balusters. The railing can also include one or more non-lighted balusters (such as 109).

Alternatively characterized, the present embodiments contemplate a railing having posts supporting first and second substantially parallel rails, with two or more balusters between adjacent posts supported at proximal and distal ends by the first and second rails, and means for lighting the balusters individually.

For purposes of this description and meaning of the appended claims, the phrase "means for lighting" expressly includes the embodiments characterized by the structure disclosed herein and equivalents thereof that are capable of individually lighting the lighted balusters, and thereby not lighting the non-lighted balusters. This means, for example, that the phrase "means for lighting" expressly does not include previously attempted solutions that can only illuminate all the balusters, such as systems that illuminate the entire rail adjacent all the balusters, and the like.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on types of material and manner of fastening the components of a railing together without departing from the scope and spirit of the present invention. In addition, although the preferred embodiments described herein are directed to a railing, it will be appreciated by those skilled in the art that the teachings of the present invention can be applied to other systems such as but not limited to a fence or a room divider without departing from the spirit and scope of the present invention.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the appended claims.

What is claimed is:

1. A railing comprising:

a pair of upright adjacent posts;

substantially parallel and spatially disposed opposing rails supported by the posts;

two or more balusters spatially disposed between the pair of adjacent posts defining spaces between adjacent balusters, each baluster attached at one end to one of the rails and attached at the other end to the other of the rails; and an illuminating feature attached to at least one of the balusters.

2. The railing of claim 1 wherein at least one of the balusters is characterized by a cross section defining an annular region, and wherein the illuminating feature comprises an electrical socket supported by the baluster within the annular region.

3. The railing of claim 2 wherein the illuminating feature comprises a light emitting member that is operably removable from the wicket and replaceable without disturbing the disposition of the respective baluster in relation to the rails and the posts.

4. The railing of claim 3 wherein the light emitting member comprises a light emitting diode.

5. The railing of claim 1 wherein at least one of the balusters comprises a solid light transmitting sheet with the illuminating feature disposed in an edgewise relation to the sheet.

6. The railing of claim 5 wherein the at least one of the baluster comprises an end cap that is attachable to one of the rails, the end cap defining a slot that is sized to receiving glee engage one end of the sheet, and the illuminating feature comprising a light emitting member adjacent the slot.

7. The railing of claim 6 wherein the light emitting member comprises a light emitting diode.

8. The railing of claim 2 wherein the baluster defines an internal passage in communication with the annular region, the passage sized for passing an electrical conductor to the socket.

9. The railing of claim 8 wherein one of the posts and rails defines a second passage in communication with the longitudinal passage, the second passage sized for passing an electrical conductor to the socket.

10. The railing of claim 9 wherein the second passage is a centrally disposed bore.

11. The railing of claim 9 wherein the second passage is a slot.

12. A railing comprising:

a pair of adjacent upright posts;

substantially parallel and spatially disposed opposing rails supported by the posts;

a plurality of balusters spanning the rails between the adjacent pair of posts, the plurality of balusters defining first spaces between adjacent balusters and defining second spaces between each post and the respective adjacent baluster and an illuminating member attached to at least one of the plurality of balusters.

13. The railing of claim 12 wherein each baluster to which the illuminating feature is attached comprises a cross section defining an annular region, and wherein the illuminating feature comprises an electrical socket within the annular region.

14. The railing of claim 13 wherein the illuminating feature compress a light emitting diode that is operably removable form the socket and replaceable without disturbing the disposition of the baluster in relation to the rails.

15. The railing of claim 12 wherein each baluster comprises a solid light transmitting sheet with the illuminating member disposed in an edgewise relation to the sheet.

16. The railing of claim 15 wherein each baluster comprises an end cap that is attachable to one of the rails, the end cap defining a slot that is sized to receivingly engage one end of the sheet, said illuminating feature further comprising a light emitting diode adjacent the slot.

17. A railing comprising:

a pair of adjacent upright posts;

substantially parallel and spatially disposed opposing rails supported by the posts;

a plurality of balusters spanning the rails between the adjacent pair of posts, at least one of the balusters having a light transmitting member, the plurality of balusters defining first spaces between adjacent balusters and defining second spaces between each post and the respective adjacent baluster;

an end cap that is attachable to one of the rails, the end cap defining a support feature that is sized to supportingly engage one end of the light transmitting member; and a light emitting diode disposed adjacent the support feature to operably illuminate the light transmitting member.

* * * * *